US007594653B2

(12) United States Patent
Shiohara et al.

(10) Patent No.: US 7,594,653 B2
(45) Date of Patent: Sep. 29, 2009

(54) MEDIUM FEEDING APPARATUS, LIQUID EJECTING APPARATUS AND RECORDING APPARATUS

(75) Inventors: Hiroshi Shiohara, Shajiri (JP); Junya Kato, Matsumoto (JP); Yutaka Nagashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 11/599,525

(22) Filed: Nov. 13, 2006

(65) Prior Publication Data

US 2007/0122226 A1 May 31, 2007

(30) Foreign Application Priority Data

Nov. 11, 2005 (JP) ..... 2005-326963

(51) Int. Cl.
*B65H 1/00* (2006.01)

(52) U.S. Cl. ..... 271/171; 271/157; 271/162; 271/120; 271/127; 271/254

(58) Field of Classification Search ..... 271/120, 271/127, 254, 157, 162, 171
See application file for complete search history.

(56) References Cited

U.S. PATENT DOCUMENTS 4,228,994 A * 10/1980 Volpe ..... 271/250
4,714,243 A * 12/1987 Staniszewski ..... 271/171
5,127,646 A * 7/1992 Matsuda et al. ..... 271/171
5,370,380 A * 12/1994 Suzuki et al. ..... 271/21
5,909,872 A * 6/1999 Takahashi ..... 271/116
5,918,873 A * 7/1999 Saito et al. ..... 271/10.11
5,975,517 A * 11/1999 Lim ..... 271/117
6,402,139 B1 * 6/2002 Kanno ..... 271/240
6,412,773 B1 * 7/2002 Takagi ..... 271/171
7,134,658 B2 * 11/2006 Shimomura et al. ..... 271/227
7,510,180 B2 * 3/2009 Jang et al. ..... 271/127
2002/0014734 A1 * 2/2002 Sugino et al. ..... 271/121
2003/0080496 A1 * 5/2003 Siow et al. ..... 271/171
2003/0151188 A1 * 8/2003 Imahara ..... 271/171
2003/0230844 A1 * 12/2003 Shimoyama ..... 271/127
2004/0051234 A1 * 3/2004 Lien et al. ..... 271/171
2005/0062217 A1 * 3/2005 Asada ..... 271/162
2005/0151315 A1 * 7/2005 Yokoi ..... 271/145
2006/0082044 A1 * 4/2006 Aida ..... 271/145
2009/0066011 A1 * 3/2009 Ohno et al. ..... 271/171

FOREIGN PATENT DOCUMENTS

JP 5-12428 2/1993

(Continued)

*Primary Examiner*—Patrick H Mackey
*Assistant Examiner*—Prasad V Gokhale
(74) *Attorney, Agent, or Firm*—Nutter McClennen & Fish LLP; John J. Penny, Jr.

(57) ABSTRACT

A medium feeding apparatus includes: a pivot unit, supporting a medium and pivoting to cause the medium to come in contact with and to separate from a feeding unit; a first guide unit, guiding one side end of the medium supported on the pivot unit; a second guide unit, guiding the other side end of the medium; a first moving unit, moving the first guide unit to come in contact with and to separate from the one side end of the medium in conjunction with the pivoting motion of the pivot unit; and a second moving unit, moving the second guide unit to come in contact with and to separate from the other side end of the fed medium in conjunction with the movement of the first guide unit.

6 Claims, 11 Drawing Sheets

FOREIGN PATENT DOCUMENTS

| | | |
|---|---|---|
| JP | 6-127707 | 5/1994 |
| JP | 7-242341 | 9/1995 |
| JP | 7-285682 | 10/1995 |
| JP | 2002-226056 | 8/2002 |
| JP | 2003-267560 | 9/2003 |
| JP | 2004-155109 | 6/2004 |

* cited by examiner

MEDIUM FEEDING APPARATUS, LIQUID EJECTING APPARATUS AND RECORDING APPARATUS

BACKGROUND

1. Technical Field

The present invention relates to a medium feeding apparatus for feeding a medium to be fed, a liquid ejecting apparatus including the medium feeding apparatus, and a recording apparatus.

2. Related Art

In a printer of an ink jet type to be one of general recording apparatuses, an automatic paper feeding apparatus is provided in an upper part on a back side. The automatic paper feeding apparatus comprises a hopper for supporting a paper together with a paper support and a paper feeding roller disposed opposite to the hopper and serving to feed the paper which is supported. A guide for regulating a support position of the paper and guiding the feed of the paper is attached to the hopper. Two guides are provided to carry out the regulation and the guide in contact with both side ends of the paper, respectively. One of the guides serves as a fixing guide fixed to the hopper and the other guide serves as a moving guide for being slid in a transverse direction of the paper over the hopper.

A user mounts a paper on the hopper and then slides the moving guide to cause the fixing guide and the moving guide to come in contact with each side end of the paper, respectively. However, a guide operation is carried out by a visual observation of the user. Therefore, a variation is easily generated in a gap between each side end of the paper and each guide. For this reason, in the case in which the gap is large, there is a possibility that the paper might be inclined in the feed of the paper, causing a paper jam. In the case in which the gap is small, there is a possibility that a frictional resistance (a back tension) between each side end of the paper and each guide might be increased to generate a paper feeding failure in the feed of the paper. Therefore, a guide is provided with a limiter mechanism to set a constant gap between each side end of the paper and each guide, thereby reducing a frictional resistance (a back tension) between the side end of the paper and the guide (see Patent Document 1).

Patent Document 1: JP-UM-A-5-12428

In the printer of the ink jet type, the constant gap is always set between each side end of the paper and each guide. For this reason, there is a possibility that the paper might become loose due to a friction between the papers or a vibration in a recording operation, causing both side ends of the paper to come in contact with the fixed guide and the moving guide. When such a contact is generated, a frictional resistance (a back tension) between both side ends of the paper and the fixed guide and moving guide is increased in the feed of the paper so that the paper feeding failure is generated. In a recording operation in the latter stage of the paper feed, particularly, there is a possibility that recording precision might be deteriorated.

SUMMARY

An advantage of some aspects of the invention is to provide a medium feeding apparatus capable of eliminating a frictional resistance between both side ends of a medium to be fed and each guide unit when feeding the medium to be fed, a liquid ejecting apparatus including the medium feeding apparatus, and a recording apparatus.

The advantage can be attained as at least one of the following aspects:

A first aspect of the invention is to provide a medium feeding apparatus comprising: a pivot unit, supporting a medium and pivoting to cause the medium to come in contact with and to separate from a feeding unit; a first guide unit, guiding one side end of the medium supported on the pivot unit; a second guide unit, guiding the other side end of the medium; a first moving unit, moving the first guide unit to come in contact with and to separate from the one side end of the medium in conjunction with the pivoting motion of the pivot unit; and a second moving unit, moving the second guide unit to come in contact with and to separate from the other side end of the fed medium in conjunction with the movement of the first guide unit. For example, consequently, both side ends and each guide unit can be caused to come in contact with each other in the non-feed of the medium to be fed and the initial stage of the feed, and the guide unit can be separated from both side ends in the latter stage of the feed of the medium to be fed. Therefore, it is possible to eliminate a frictional resistance between both side ends and the guide unit in the latter stage of the feed of the medium to be fed.

Moreover, the invention may be characterized in that the pivot unit is also moved with the movement of the first guide unit. Consequently, it is possible to separately constitute an automatic moving mechanism of the first guide unit by the first moving unit and a manual moving mechanism of the first guide unit by a user. Moreover, the first moving unit may be characterized by a guide protruded portion and a guide groove to be engaged with the guide protruded portion. The guide groove may be characterized by a straight groove formed on the side of the feeding unit extended in a pivoting direction of the pivot unit and an inclined groove formed on an opposite side to the feeding unit inclined with respect to the straight groove. Consequently, the first moving unit to be in conjunction with the pivoting motion of the pivot unit can have a simple structure. Moreover, the second moving unit may be characterized by a pair of pinion gears and a pair of rack gears to be engaged with the pinion gears. The invention is characterized in that the pinion gears may be attached to the pivot unit and the rack gears may be attached to the second moving unit. Consequently, the second moving unit to be in conjunction with the movement of the first guide unit can have a simple structure.

A second aspect of the invention is to provide a liquid ejecting for ejecting a liquid onto a medium to be ejected and comprises any of the medium feeding apparatuses.

Moreover, a third aspect of the invention is to provide a recording apparatus for carrying out recording over a medium to be recorded and comprises any of the medium feeding apparatuses. Consequently, it is possible to provide a medium feeding apparatus or a recording apparatus which can produce each of the functions and advantages.

Moreover, a fourth aspect of the invention is to provide a medium feeding apparatus comprising: a pivot unit having a protruded portion at lower edge thereof; an abutment portion, disposed below the pivot unit and having a groove therein; a first guide unit, fixing its position with respect to the pivot unit while the pivot unit pivots; a second guide unit, disposed opposite to the first guide unit with respect to the pivot unit, wherein the protruded portion of the pivot unit moves along the groove of the abutment portion and thereby the first guide unit and the second guide unit change the distance therebetween.

In the fourth aspect of the invention, it is preferably that the groove including a straight groove extended in a direction of the pivoting motion of the pivot unit and an inclined groove which is inclined with respect to the straight groove and thereby the first guide unit moves toward or separates from the second guide unit.

In the fourth aspect of the invention, it is preferably that a pair of pinion gears attached to the pivot unit and a pair of rack gears are engaged with each other and thereby the second guide unit moves toward or separates from the first guide unit.

The present disclosure relates to the subject matter contained in Japanese patent application No. 2005-326963 filed on Nov. 11, 2005, which is expressly incorporated herein by reference in its entirety.

DESCRIPTION OF EXEMPLARY EMBODIMENTS

An embodiment according to the invention will be described with reference to the drawings. The embodiment which will be described below is not restricted to the invention according to the claims and all of combinations of the features described in the embodiment are not always essential to the means for solution according to the invention.

Figure 1:
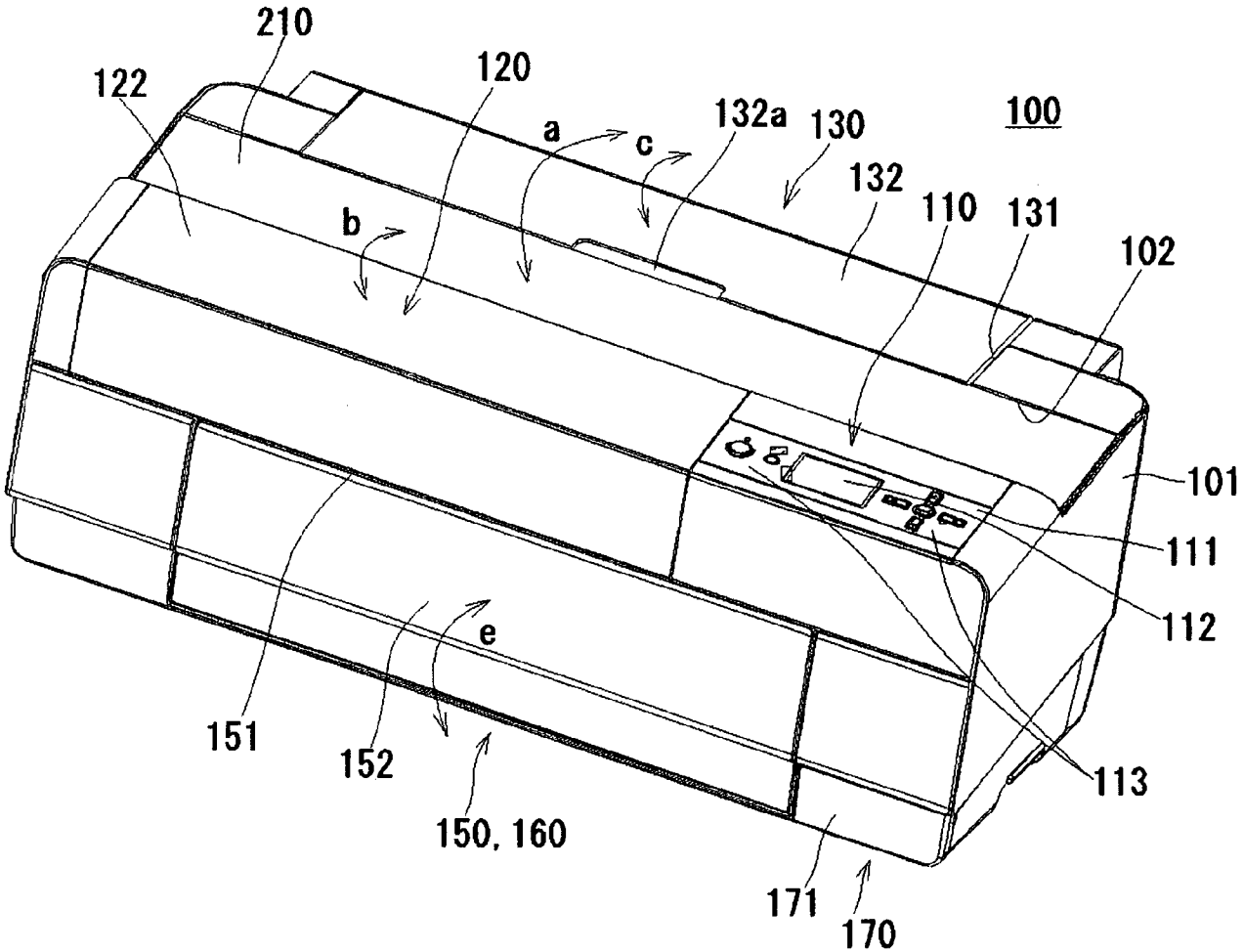
FIG. 1 is a perspective view showing a whole structure of an appearance of a printer of an ink jet type to be one of recording apparatuses according to an embodiment of the invention as seen obliquely from a front part.
Figure 2:
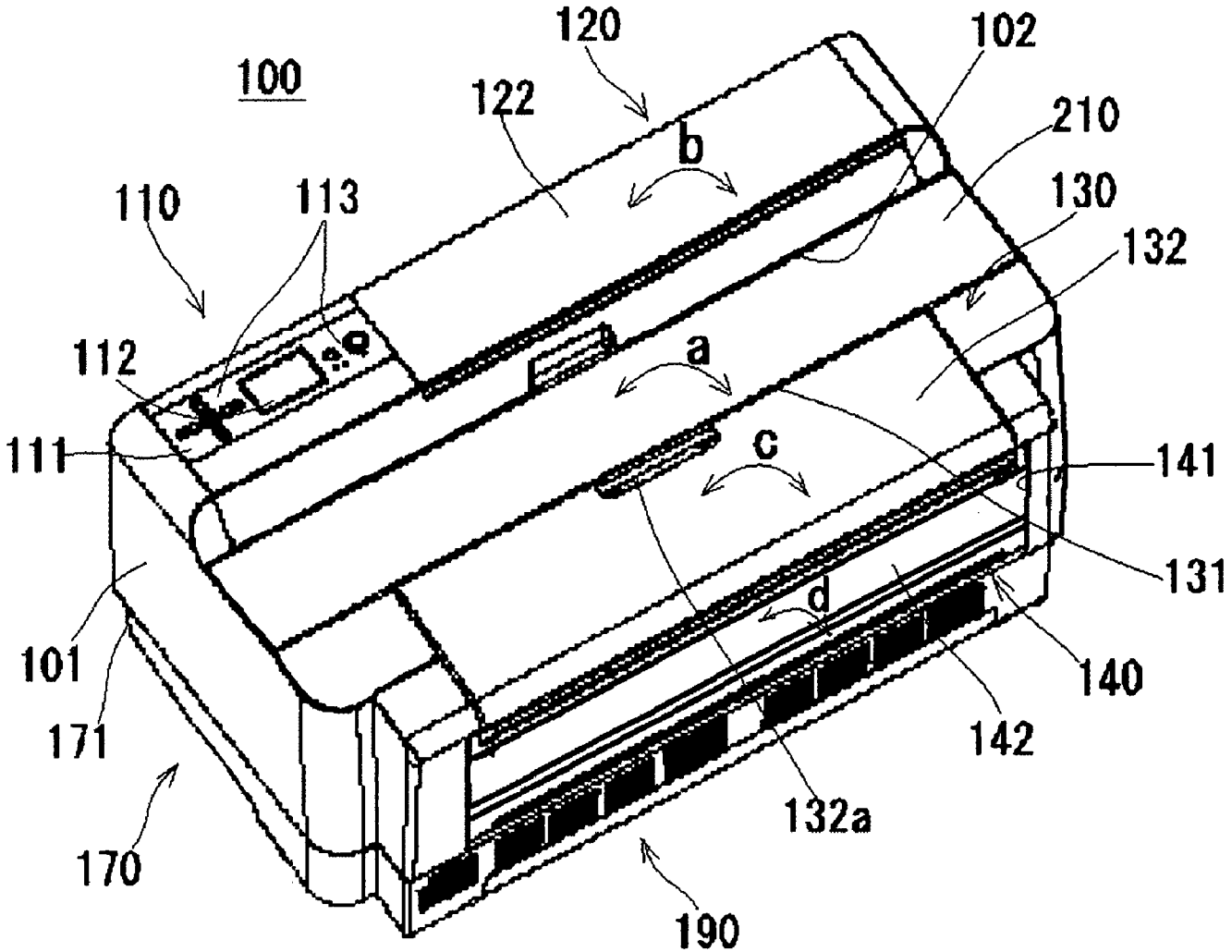
FIG. 2 is a perspective view showing the whole structure of the appearance of the printer in FIG. 1 as seen obliquely from a rear part.
Figure 3:
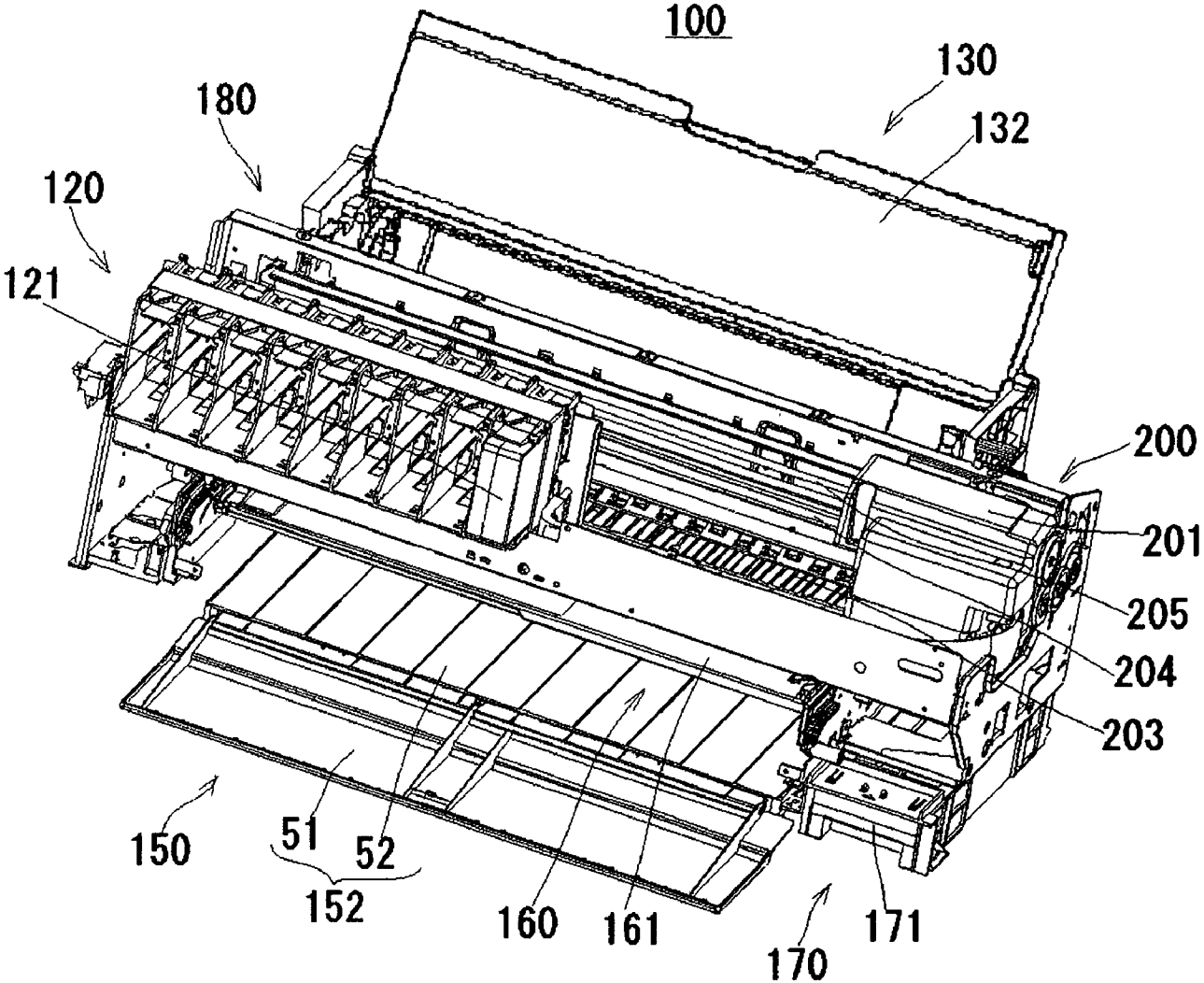
FIG. 3 is a perspective view schematically showing an internal structure of the printer in FIG. 1.
Figure 4:
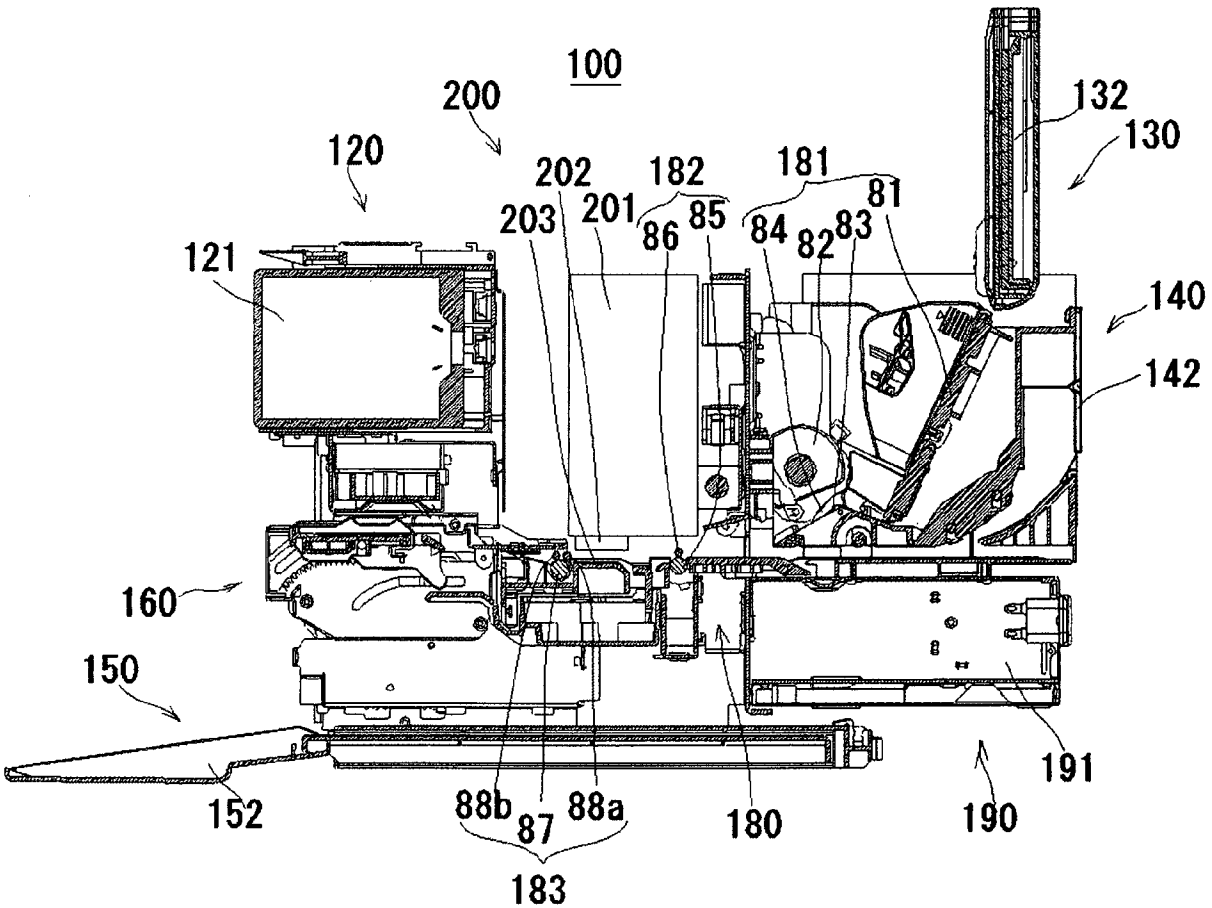
FIG. 4 is a sectional side view schematically showing the internal structure of the printer in FIG. 1.

FIGS. 1 and 2 are perspective views showing a whole structure of an appearance of a printer of an ink jet type to be one of recording apparatuses according to an embodiment of the invention as seen obliquely from front and rear parts, FIG. 3 is a perspective view schematically showing an internal structure thereof, and FIG. 4 is a sectional side view schematically showing the internal structure thereof. A printer 100 of an ink jet type has a function capable of carrying out recording, with an ink (a liquid), over a cut-form paper having a size such as an L size/2L size, a postcard, or an A4, A3 extension or A2 size on the JIS (hereinafter referred to as a paper (a medium to be fed, a medium to be ejected or a medium to be recorded)).

The printer 100 of the ink jet type is covered with a housing 101 which wholly takes a shape of an almost rectangular parallelepiped as shown in FIGS. 1 and 2. In the housing 101, an operating portion 110 is provided at a right and front side on an upper surface shown in FIG. 1 and a cartridge housing portion 120 is provided at a left and front side on the upper surface shown in FIG. 1. Furthermore, a first rear paper feeding portion 130 is provided at a rear side on the upper surface shown in FIG. 1 and a second rear paper feeding portion 140 is provided on a back side shown in FIG. 2. A paper discharging portion 150 and a front paper feeding portion 160 are provided on a front side shown in FIG. 1 and a waste ink collecting portion 170 is provided at a right side on a front surface shown in FIG. 1. Moreover, a paper delivery portion 180 shown in FIGS. 3 and 4, a control portion 190 shown in FIGS. 2 and 4 and a recording portion 200 shown in FIGS. 3 and 4 which include characteristic portions of the invention are provided in the printer 100 of the ink jet type.

As shown in FIGS. 1 and 2, an opening portion 102 taking a rectangular shape is formed between the operating portion 110 and cartridge housing portion 120 and the first rear paper feeding portion 130 in the upper surface of the housing 101. The opening portion 102 is covered with a printer cover 210 taking a shape of an almost rectangular plate. The printer cover 210 is attached to be rotatable in a direction of an arrow "a" shown in the drawing around a rotating axis of a rear end. A user can easily carry out a maintenance work of internal mechanisms such as the paper delivery portion 180 and the recording portion 200 through the opening portion 102 by lifting the printer cover 210 to open the opening portion 102.

As shown in FIGS. 1 and 2, the operating portion 110 includes an operation panel 111 taking an almost rectangular shape, a liquid crystal panel 112 for displaying an operation state is provided in an almost central part of the operation panel 111, and a button 113 such as a power system for turning ON/OFF a power, an operating system for carrying out an operation to find the beginning of a paper and operating the flush of an ink, and a processing system for performing an image processing is provided on both sides of the liquid crystal panel 112. The user can operate the button 113 while seeing and confirming the liquid crystal panel 112. Therefore, a malfunction can be prevented.

As shown in FIGS. 1 and 2, the cartridge housing portion 120 accommodates an ink cartridge 121 shown in FIGS. 3 and 4 which stores inks having respective colors for printing (nine colors in the example) in such a manner that it can be pulled in/out. The cartridge housing portion 120 is covered with a cartridge cover 122 having an L-shaped section. The cartridge cover 122 is attached to be rotatable in a direction of an arrow "b" shown in the drawing around a rotating axis of a rear end. The user can easily exchange the ink cartridge 121 by lifting the cartridge cover 122 to open the cartridge housing portion 120. Therefore, a working efficiency can be enhanced.

The first rear paper feeding portion 130 is used for an automatic sheet feed (ASF) and includes a first paper support 132 with a four-stage structure having both a function of opening/closing a first paper feeding port 131 opened upward and rectangularly and a function of supporting at least one paper to be fed as shown in FIGS. 1 and 2. The first paper support 132 is attached to be rotatable in a direction of an arrow "C" shown in the drawing around the rotating axis of the rear end. For the paper to be fed by the first rear paper feeding portion 130, a comparatively thin paper (for example, a plain paper or a photographic paper which has a thickness of approximately 0.08 mm to 0.27 mm) is used.

Before using the printer 100 of the ink jet type, the user puts a finger in a hole 132*a* provided on a center at this side shown in the drawing in the first paper support 132 to lift the first paper support 132 and to pull out a multistage portion, thereby completing setting. Therefore, it is not necessary to carry out a storage and a maintenance which are required for a paper support of a removable type. Because of the first paper support 132 having the multistage structure, furthermore, it is possible to reliably support papers having various sizes which are to be fed. After using the printer 100 of the ink jet type, moreover, the multistage portion of the first paper support 132 is pushed in to carry out closing. Consequently, the first paper feeding port 131 can be closed. Thus, it is possible to prevent dust from entering a printer body, and furthermore, to store the first paper support 132 to be compact.

The second rear paper feeding portion 140 is used for manually feeding a paper and includes a second paper support 142 with a two-stage structure having both a function of opening/closing a second paper feeding port 141 opened to be rearward rectangular and a function of supporting one paper to be fed as shown in FIG. 2. The second paper support 142 is attached to be rotatable in a direction of an arrow "d" shown in the drawing around a rotating axis of a lower end. For a paper to be fed by the second rear paper feeding portion 140, there is used a paper having such a thickness that it cannot be fed at a delivery angle in the first rear paper feeding portion 130 (for example, a painting material paper or a special paper which has a thickness of approximately 0.29 mm to 0.48 mm). Furthermore, the first rear paper feeding portion 130 is used for the automatic sheet feed (ASF). Therefore, the paper is picked up by means of a paper feeding roller 82. When paper powder sticks to the paper feeding roller 82 and is accumulated thereon, consequently, there is a possibility that a slip might be caused in the paper feeding roller 82, resulting in a paper feeding failure. For this reason, papers to easily generate the paper powder (for example, Velvet Fine Art Paper having a thickness of approximately 0.48 mm and Ultra Smooth Fine Art Paper having a thickness of approximately 0.46 mm) are to be also fed manually by means of the second rear paper feeding portion 140.

Before using the printer 100 of the ink jet type, the user puts a finger in an upper part of the second paper support 142 which is shown in the drawing, thereby pushing the second paper support 142 downward to pull the multistage portion out. Thus, the setting is completed. Therefore, it is not necessary to carry out a storage and a maintenance which are required for the paper support of the removable type. Because of the second paper support 142 having the multistage structure, furthermore, it is possible to reliably support papers having various sizes which are to be fed. After using the printer 100 of the ink jet type, moreover, it is possible to close the second paper feeding port 141 by pushing in the multistage portion of the second paper support 142 to carry out closing. Consequently, it is possible to prevent dust from entering the printer body, and furthermore, to store the second paper support 142 to be compact.

The paper discharging portion 150 includes a stacker 152 with a two-stage structure having a first stacker 51 and a second stacker 52 shown in FIG. 3 which has both a function of opening/closing a paper discharging port 151 opened forward and rectangularly and a function of stacking at least one paper to be discharged. The first stacker 51 is attached to be rotatable in a direction of an arrow "e" shown in the drawing around a rotating axis at a tip side of the second stacker 52. The second stacker 52 is attached to be moved obliquely and vertically in parallel with respect to the paper discharging port 151 and to be freely protruded and stored.

Before using the printer 100 of the ink jet type, the user puts the finger on an upper part of the first stacker 51 to rotate the first stacker 51 toward this side, thereby opening the paper discharging port 151, and holds a tip of the first stacker 51 with fingers to pull out the first stacker 51 and moves and protrudes the second stacker 52 obliquely and upward in parallel to complete the setting. Thus, it is not necessary to carry out the storage and maintenance which is required for the stacker of the removable type. Because of the stacker 152 having the multistage structure, furthermore, the papers having various sizes to be discharged can be reliably stacked and mounted, and furthermore, the papers subjected to recording are always discharged from a front side. Consequently, the user can easily take the papers out. After using the printer 100 of the ink jet type, moreover, the tip of the first stacker 51 is pushed in by a hand to move the second stacker 52 obliquely and downward in parallel and to store the second stacker 52, and the first stacker 51 is rotated rearward with a hand so that the paper discharging port 151 can be closed. Thus, it is possible to prevent dust from entering the printer body and to store the stacker 152 to be compact.

The front paper feeding portion 160 is used for manually feeding a paper and includes a paper feeding tray 161 provided above the stacker 152 in the paper discharging port 151 as shown in FIG. 3. The paper feeding tray 161 is provided to be horizontally movable with respect to the paper discharging port 151. For a paper fed from the front paper feeding portion 160, there is used a comparatively thick paper (for example, a mat board having a thickness of approximately 1.2 mm) which cannot be bent in a delivery.

Before using the printer 100 of the ink jet type, the user lightly pushes a tip of the paper feeding tray 161 in so that a stopper of the paper feeding tray 161 slips off and the paper feeding tray 161 is protruded from the paper discharging port 151. After using the printer 100 of the ink jet type, moreover, the tip of the paper feeding tray 161 is lightly pushed in so that the stopper of the paper feeding tray 161 is hung and the paper feeding tray 161 is thus stored in the paper discharging port 151. Accordingly, it is possible to enhance an installation space efficiency of the paper feeding tray 161.

As shown in FIGS. 1 to 3, the waste ink collecting portion 170 has a waste ink tank 171 for storing a waste ink so as to be freely put in/out. The waste ink tank 171 stores the waste ink discharged in a cleaning treatment for a recording head 202 or an exchange of an ink cartridge. It is sufficient that the user simply pulls out the waste ink tank 171 and inserts a new waste ink tank 171 when the waste ink tank 171 is filled with the waste ink. Therefore, it is possible to easily carry out a work for exchanging the waste ink tank 171.

As shown in FIGS. 3 and 4, the paper delivery portion 180 is provided from the first rear paper feeding portion 130 and the second rear paper feeding portion 140 to the paper discharging portion 150, and includes an automatic paper feeding mechanism (a medium paper feeding apparatus) 181, a delivery mechanism 182, and a paper discharging mechanism 183. As shown in FIG. 4, the automatic paper feeding mechanism 181 includes a hopper (pivot unit) 81 for lifting a paper supported on the first paper support 132 so as to be fed, the paper feeding roller (feeding unit) 82 for taking out the paper lifted by the hopper 81, a retard roller 83 for separating papers fed with an overlap by the paper feeding roller 82 one by one, and a paper return lever 84 for returning the residual papers separated by the retard roller 83 to the hopper 81.

The hopper 81 is formed like a plate capable of mounting a paper thereon and is provided in almost parallel with a rear wall, and is disposed in such a manner that a lower end is positioned in the vicinity of the paper feeding roller 82 and an upper end is positioned close to a top of the rear wall. The hopper 81 has a back face on the lower end side to which one of ends of a compression spring (not shown) having the other end attached to the rear wall is fixed, and is provided in such a manner that the lower end side is turned around the upper end side by the expansion and contraction of the compression spring.

The paper feeding roller 82 is formed like a D shape with a part of a section taken away and is provided in the vicinity of the lower end of the hopper 81, and is intermittently rotated to frictionally feed the paper lifted by means of the hopper 81. The retard roller 83 is provided to freely abut on the paper feeding roller 82 and serves to frictionally separate only a paper on an uppermost layer from papers on lower layers when the papers are fed with an overlap by means of the paper feeding roller 82. The paper return lever 84 is formed like a click and is provided in the vicinity of the paper feeding roller 82, and serves to hang the paper on the lower layer separated by the retard roller 83 onto a click, thereby returning the paper to the hopper 81.

The delivery mechanism 182 is provided with a paper feeding roller 85 for feeding a paper in a secondary scanning direction synchronously with a recording operation and a driven roller 86 as shown in FIG. 4. The paper feeding roller 85 is provided on an upstream side of a delivery of a platen 203 and serves to interpose a paper fed by the paper feeding roller 82 together with the driven roller 86 and to feed the paper to the platen 203.

The paper discharging mechanism 183 includes a paper discharging roller 87, and a first support roller 88*a* and a second support roller 88*b* as shown in FIG. 4. The first support roller 88*a* is provided on a downstream side of the delivery of the platen 203, and the second support roller 88*b* and the paper discharging roller 87 are provided opposite to each other on the downstream side of the delivery of the first support roller 88*a*. The paper passing through the platen 203 is first discharged and fed by the first support roller 88*a*, and subsequently, is interposed between the second support roller 88*b* and the paper discharging roller 87 and is thus discharged onto the stacker 152. The first support roller 88*a* and the second support roller 88*b* are held by the same holding member which is not shown.

The control portion 190 includes a main substrate 191 constituting a printer controller as shown in FIG. 4. Control devices and storage devices such as a CPU, an ROM, an RAM and an ASIC which are not shown and other various circuit devices are attached to the main substrate 191. The control portion 190 serves to control the paper delivery portion 180 and the recording portion 200 which constitute a print engine.

The recording portion 200 is provided with a carriage 201 to be moved in a primary scanning direction synchronously with a recording operation, the recording head 202 for discharging an ink synchronously with the recording operation, and the platen 203 for flatly holding the paper in the recording operation as shown in FIG. 4. A carriage guide shaft 204 is provided through the carriage 201 above the platen 203 so that the carriage 201 is coupled to a carriage belt 205 as shown in FIG. 3. When the carriage belt 205 is operated by means of a carriage motor which is not shown, the carriage 201 is guided and reciprocated by means of the carriage guide shaft 204 in accordance with the motion of the carriage belt 205.

The recording head 202 is mounted on the carriage 201 to form a predetermined interval from the platen 203 as shown in FIG. 4, and can discharge inks having two kinds of black colors such as photo black and mat black, and seven colors such as yellow, cyan, light cyan, magenta, light magenta, gray and red, respectively. More specifically, in the recording head 202, a pressure generating chamber and a nozzle opening connected thereto are provided on a nozzle plate. By storing the ink in the pressure generating chamber to carry out a pressurization at a predetermined pressure, ink droplets having sizes controlled are discharged from the nozzle opening toward the paper. The platen 203 is provided opposite to the recording head 202 between the paper feeding roller 85 and the paper discharging roller 87 and serves to support the delivered paper through a face. Next, the details of the automatic paper feeding mechanism 181 including the characteristic portions of the invention will be further described with reference to the drawings.

Figure 5:
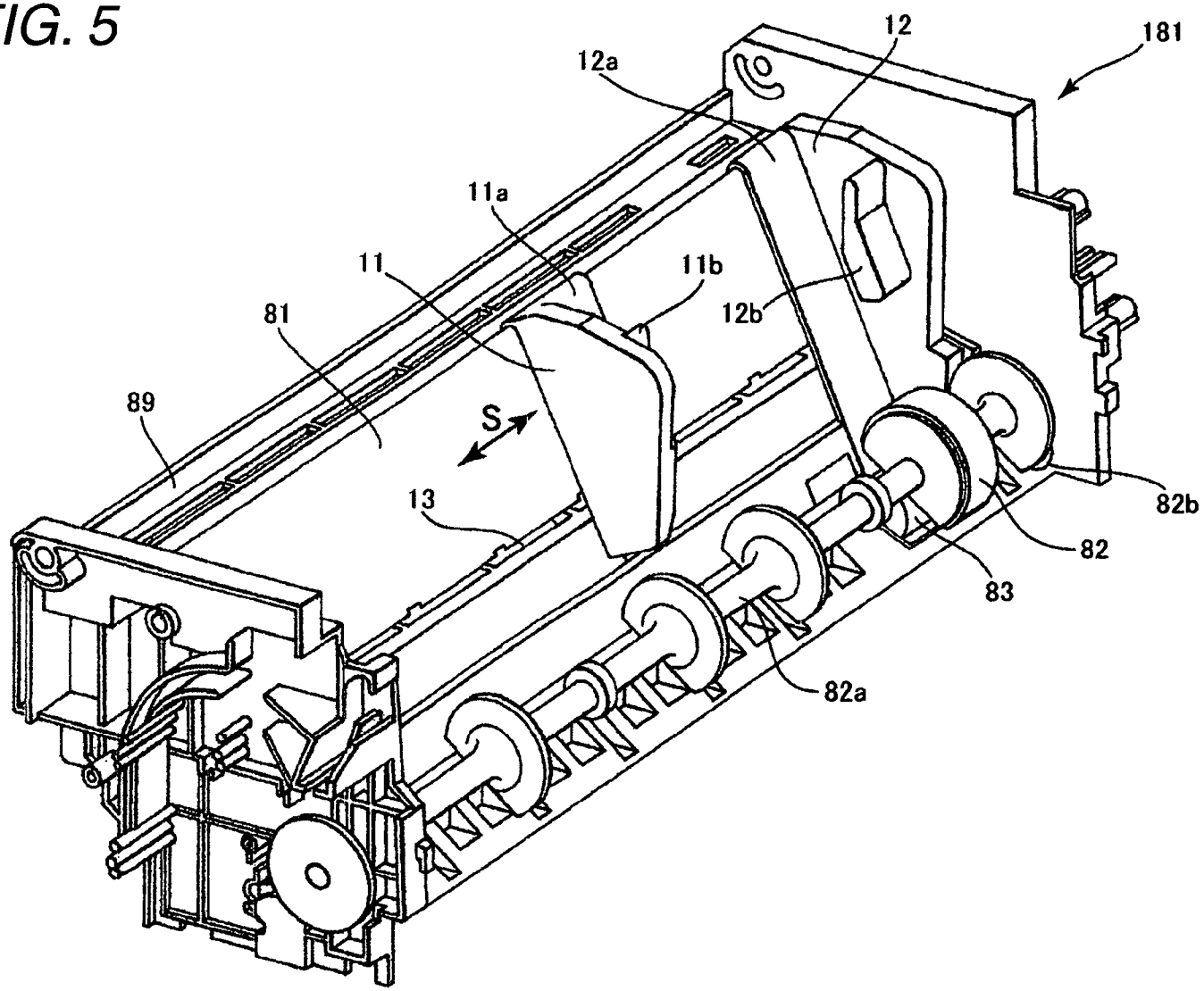
FIG. 5 is a perspective view showing an automatic paper feeding mechanism of the printer in FIG. 1.
Figure 6:
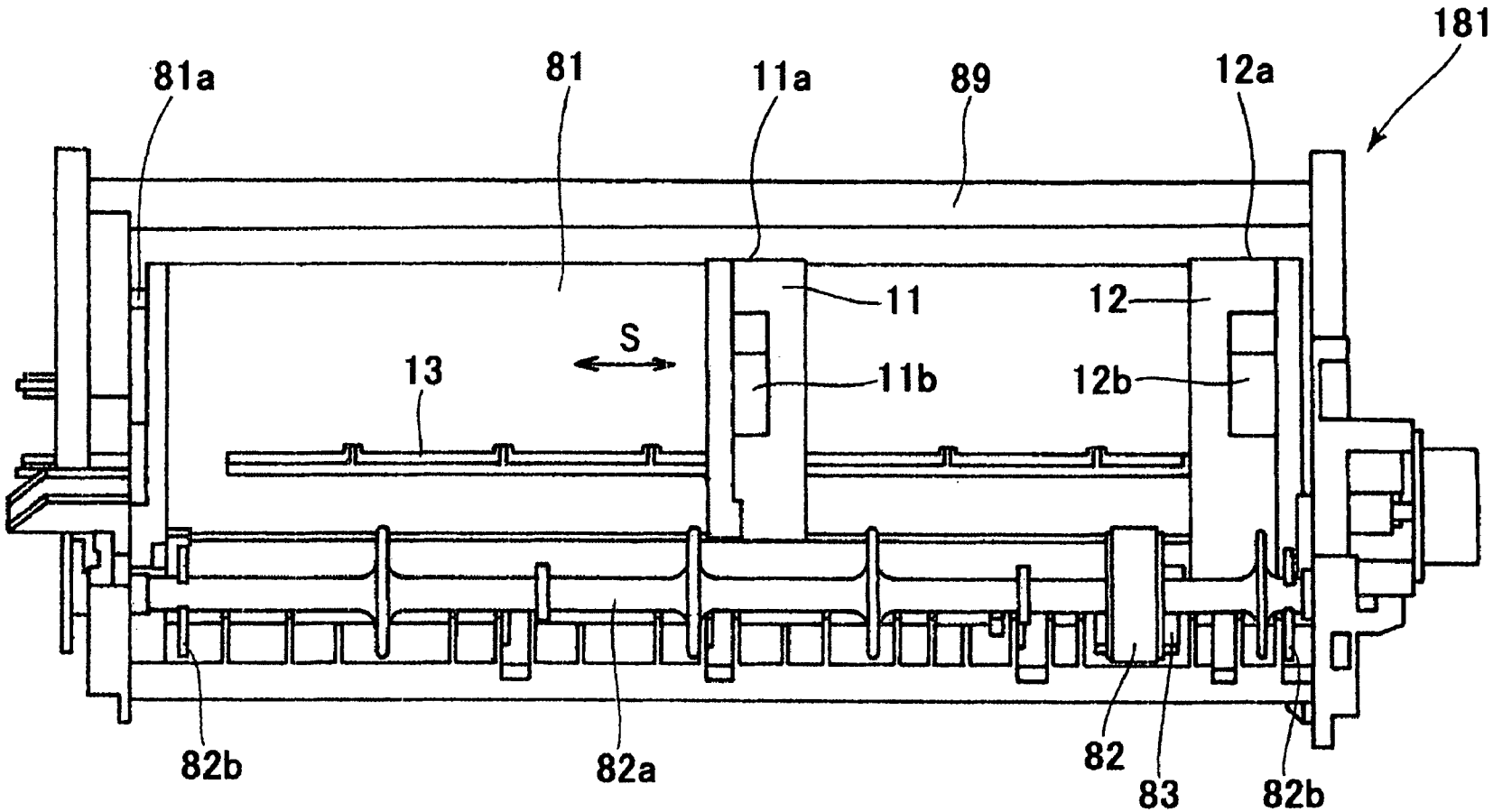
FIG. 6 is a front view of FIG. 5.
Figure 7:
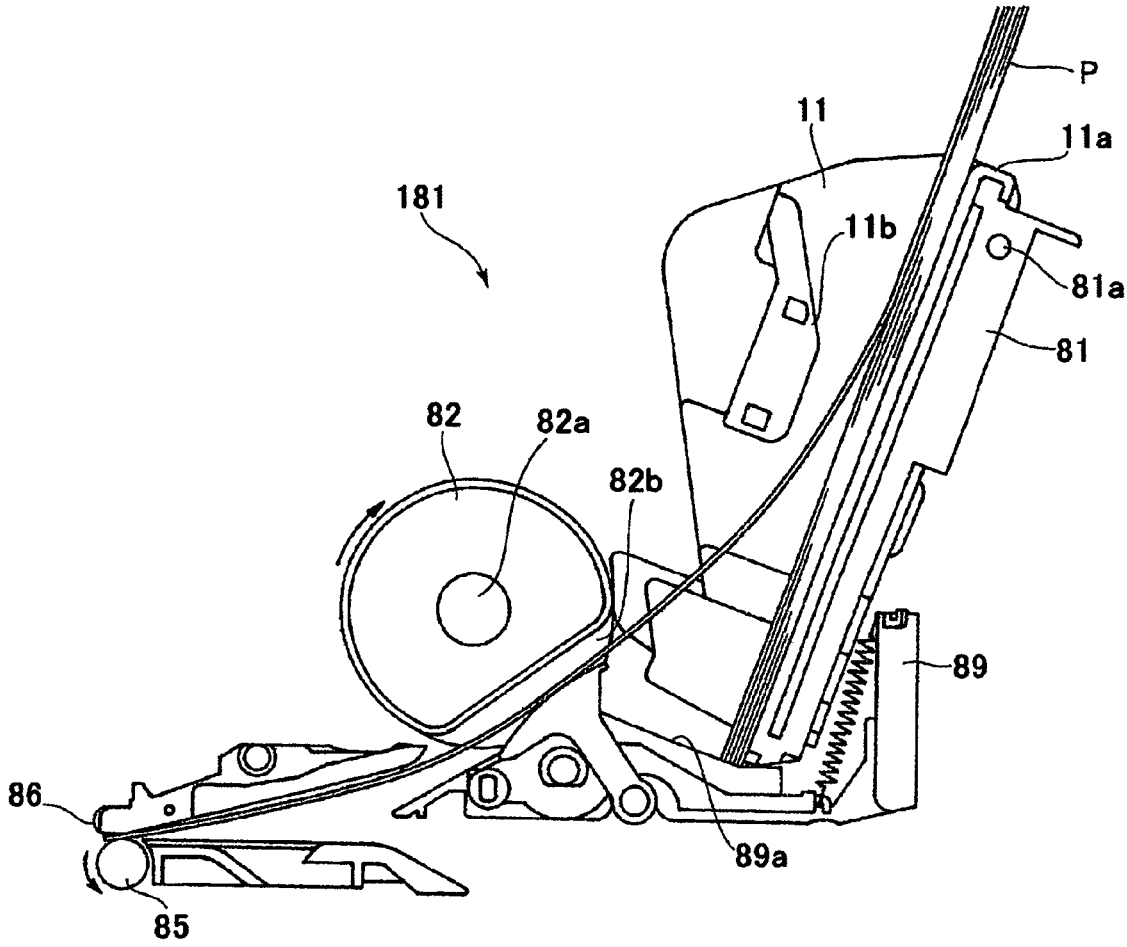
FIG. 7 is a side view of FIG. 5, FIGS. 8A and 8B are a side view showing an edge guide moving mechanism in the automatic paper feeding mechanism illustrated in FIG. 5, FIGS. 9A and 9B are sectional views taken along IXA-IXA of FIG. 8A and IXB-IXB in FIG. 8B respectively.

FIG. 5 is a perspective view showing the automatic paper feeding mechanism 181, FIG. 6 is a front view showing the same, and FIG. 7 is a side view showing the same. In the automatic paper feeding mechanism 181, the hopper 81, the paper feeding roller 82, the retard roller 83 and the paper return lever 84 are provided in a paper feeding frame 89 taking such a shape as to surround three directions including both side surface sides of the printer and aback side of the printer. More specifically, the paper feeding roller 82 is disposed on a forward side of a lower part of the hopper 81 opposite thereto and the retard roller 83 is disposed opposite below the paper feeding roller 82, and a plurality of paper return levers 84 is arranged on both sides of the retard roller 83.

The hopper 81 is provided to be pivotable toward the paper feeding roller 82 side in a predetermined timing in the feed of the paper around a shaft 81*a*. More specifically, the hopper 81 is engaged with a hopper cam 82*b* formed integrally in the vicinity of both ends of a paper feeding roller shaft 82*a* and a position thereof is regulated, and at the same time, the hopper 81 is pivoted by the rotation of the hopper cam 82*b* with the rotation of the paper feeding roller shaft 82*a*. The hopper 81 is provided with an edge guide (first guide unit) 11 for guiding one end side in the primary scanning direction of a paper P stacked on the paper feeding frame 89 and a reference end guide (second guide unit) 12 for regulating, into a reference end, the other end side in the primary scanning direction of the paper P stacked on the paper feeding frame 89 and guiding the paper P.

The edge guide 11 is hung and attached to an upper end of the hopper 81 through an arm portion 11*a*, and furthermore, is provided to be manually slidable in a direction shown in S corresponding to a size of the paper P in engagement with a long slot 13 in the primary scanning direction which is formed on the hopper 81. The edge guide 11 is provided with a rise preventing guide 11*b* for preventing the fed paper P from rising. Similarly, the reference end guide 12 is hung and attached to the upper end of the hopper 81 through an arm portion 12*a*, and furthermore, is provided to be automatically slidable in the direction shown in S in a release operation which will be described below in engagement with the long slot 13 in the primary scanning direction which is formed on the hopper 81. The reference end guide 2 is also provided with a rise preventing guide 12*b* for preventing the paper P fed from the paper feeding frame 89 from rising.

As described in the background art, when both side ends of the paper come in contact with the edge guide 11 and the reference end guide 12, a frictional resistance between the both side ends of the paper and the edge guide 11 and reference end guide 12 is increased in the feed of the paper, resulting in a paper feeding failure. In the recording operation in the latter stage of the paper feed, particularly, there is a possibility that recording precision might be deteriorated. In the embodiment, therefore, there is employed a structure in which the edge guide 11 and the reference end guide 12 are particularly released from both side ends of the paper in the recording operation in the latter stage of the paper feed. Description will be given with reference to the drawings.

Figure 8A:
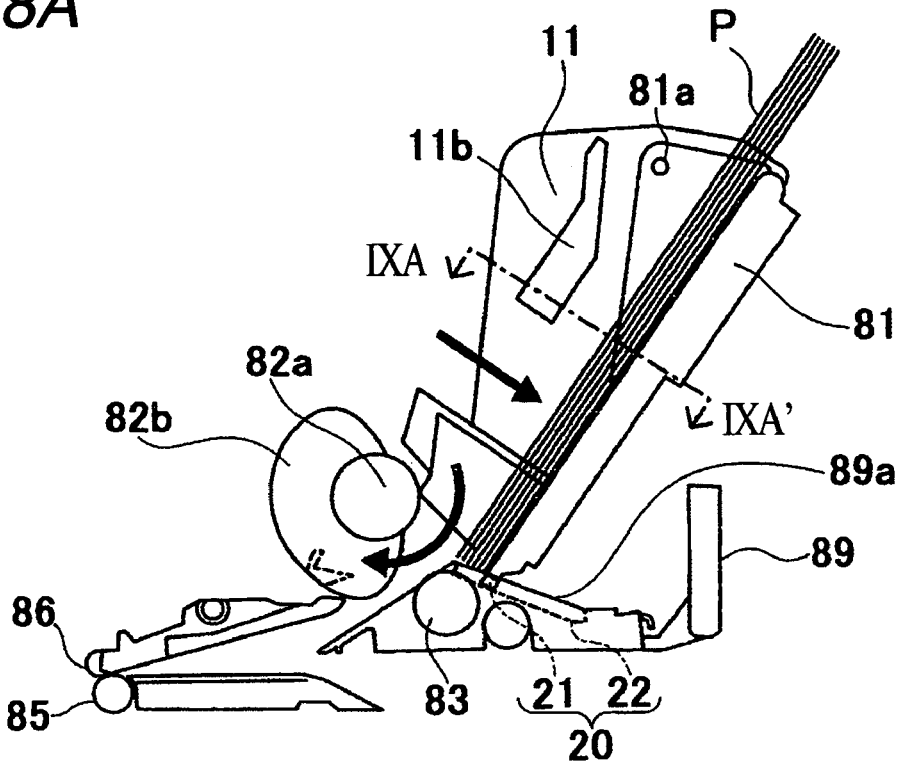
Figure 8B:
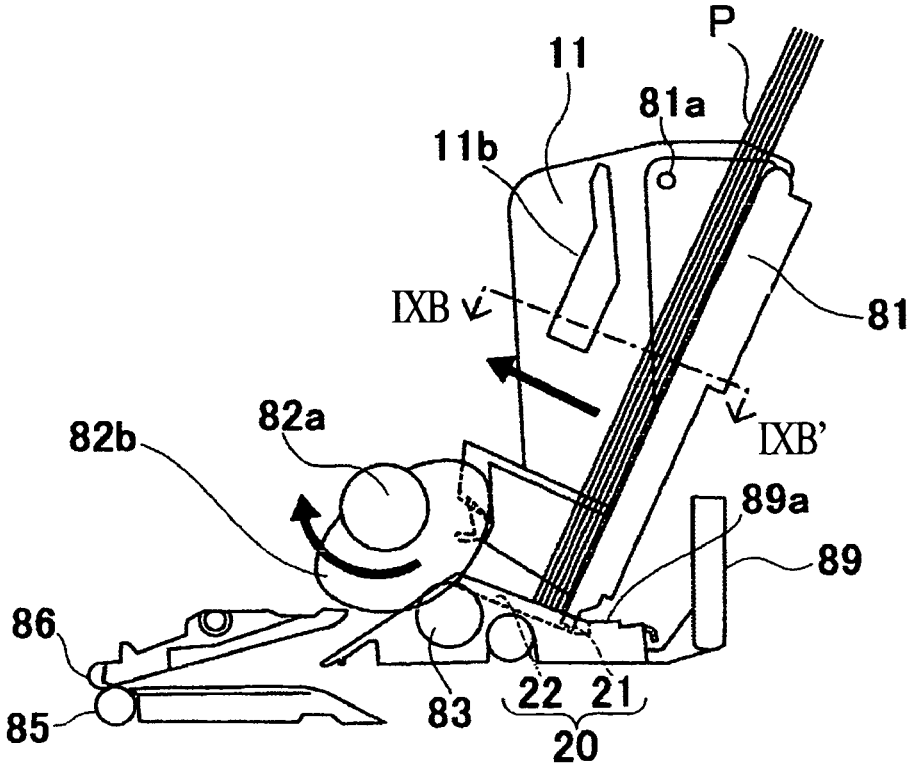
Figure 9A:
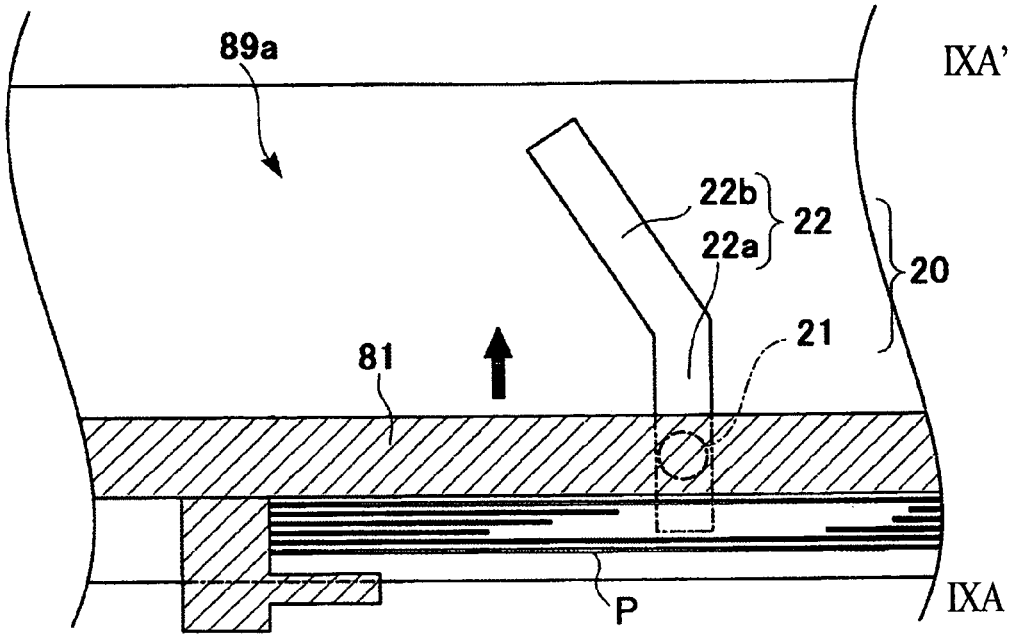
Figure 9B:
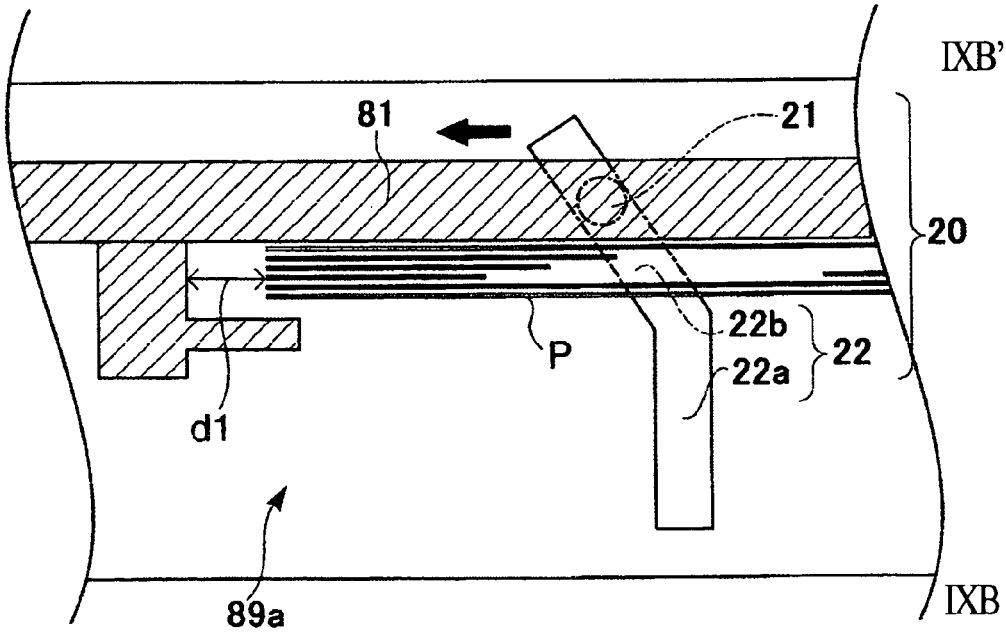

FIGS. 8A and 8B are side views showing a mechanism for moving the edge guide 11, and FIGS. 9A and 9B are sectional views taken along IXA-IXA' in FIG. 8A and IXB-IXB' in FIG. 8B respectively. As shown in FIGS. 8A and 8B, an edge guide moving mechanism (first moving unit) 20 includes a guide protruded portion 21 formed on the lower end of the hopper 81 and a guide groove 22 formed on an abutment portion 89*a* on which a lower end of the paper P supported on the hopper 81 abuts. The guide protruded portion 21 is engaged with the guide groove 22 and is thus moved along the guide groove 22.

The guide groove 22 is constituted by a straight groove 22*a* extended in the pivoting direction of the hopper 81 and formed on the paper feeding roller 82 side and an inclined groove 22*b* inclined with respect to the straight groove 22*a* and formed on the opposite side of the paper feeding roller 82. The hopper 81 is provided to be pivotable toward the paper feeding roller 82 side and to be movable in the primary scanning direction. When the hopper 81 is pivoted in such a direction as to separate from the paper feeding roller 82, accordingly, the guide protruded portion 21 passes through the straight groove 22*a* of the guide groove 22 as shown in FIG. 9A and then passes through the inclined groove 22*b* as shown in FIG. 9B. Accordingly, the guide protruded portion 22*a* is moved in the primary scanning direction by the inclined groove 22*b*. Thus, the hopper 81 is also moved in the primary scanning direction together with the edge guide 11.

Figure 10:
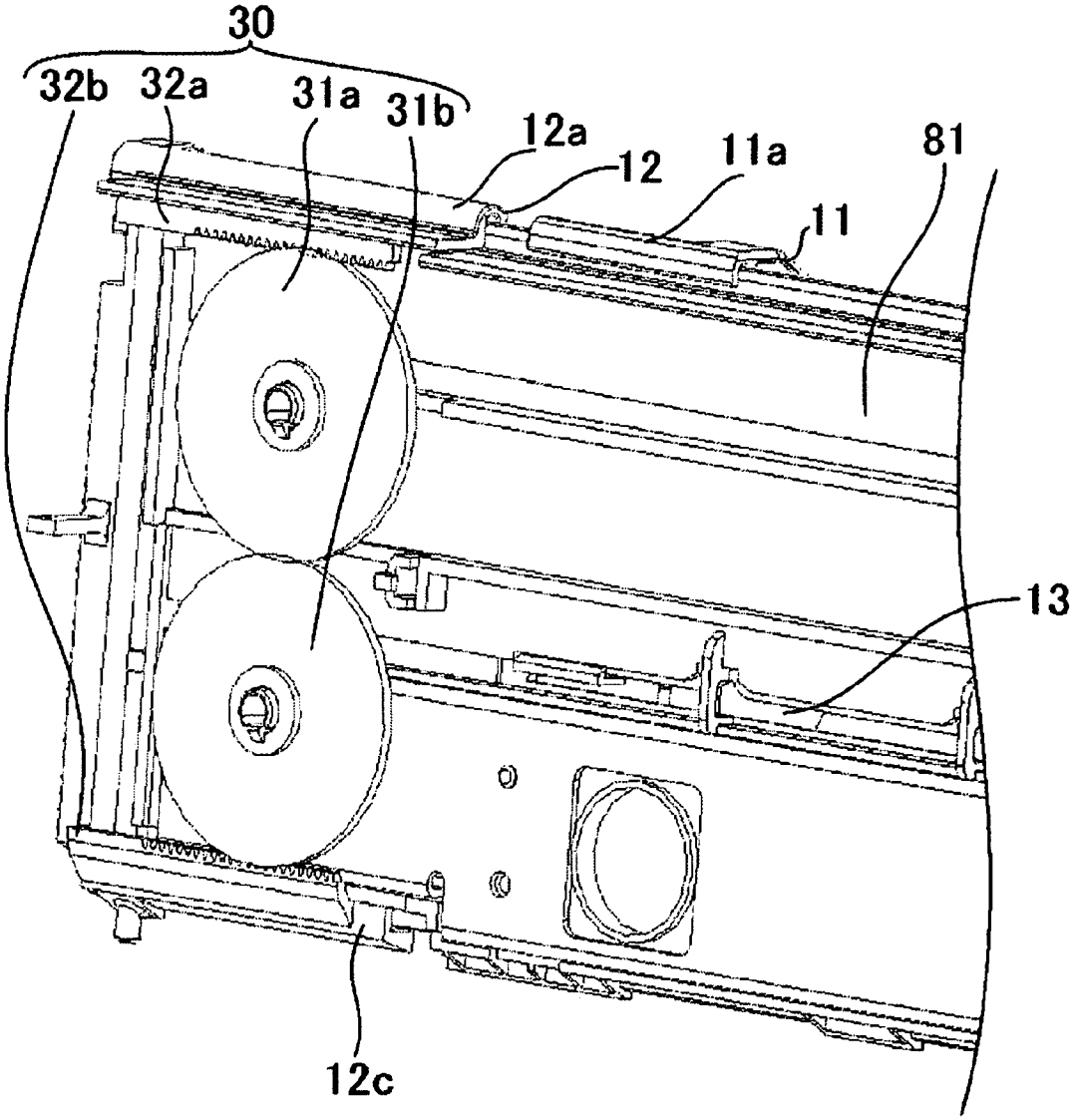
FIG. 10 is a perspective view showing a reference end guide moving mechanism in the automatic paper feeding mechanism illustrated in FIG. 5, and FIGS. 11A and 11B are plan views showing an operation of each moving mechanism.

FIG. 10 is a perspective view showing a mechanism for moving the reference end guide 12. A reference end guide moving mechanism (second moving unit) 30 includes two pinion gears 31*a* and 31*b* provided on the back side of the hopper 81, and rack gears 32*a* and 32*b* provided on the arm portion 12*a* and a lower portion 12*c* in the reference end guide 12 and engaged with the pinion gears 31*a* and 31*b*. At the same time that the hopper 81 is moved in the primary scanning direction together with the edge guide 11 by means of the edge guide moving mechanism 20, accordingly, the pinion gears 31*a* and 31*b* are rotated reversely to move the rack gears 32*a* and 32*b* together with the reference end guide 12 in the primary scanning direction. Thus, the pinion gears 31*a* and 31*b* and the rack gears 32*a* and 32*b* are disposed vertically. Therefore, the reference end guide 12 and the hopper 81 can be smoothly moved in parallel without a wrench. Even if the wrench is caused by an increase in a width of the reference end guide 12, a backlash can be minimized.

Figure 11A:
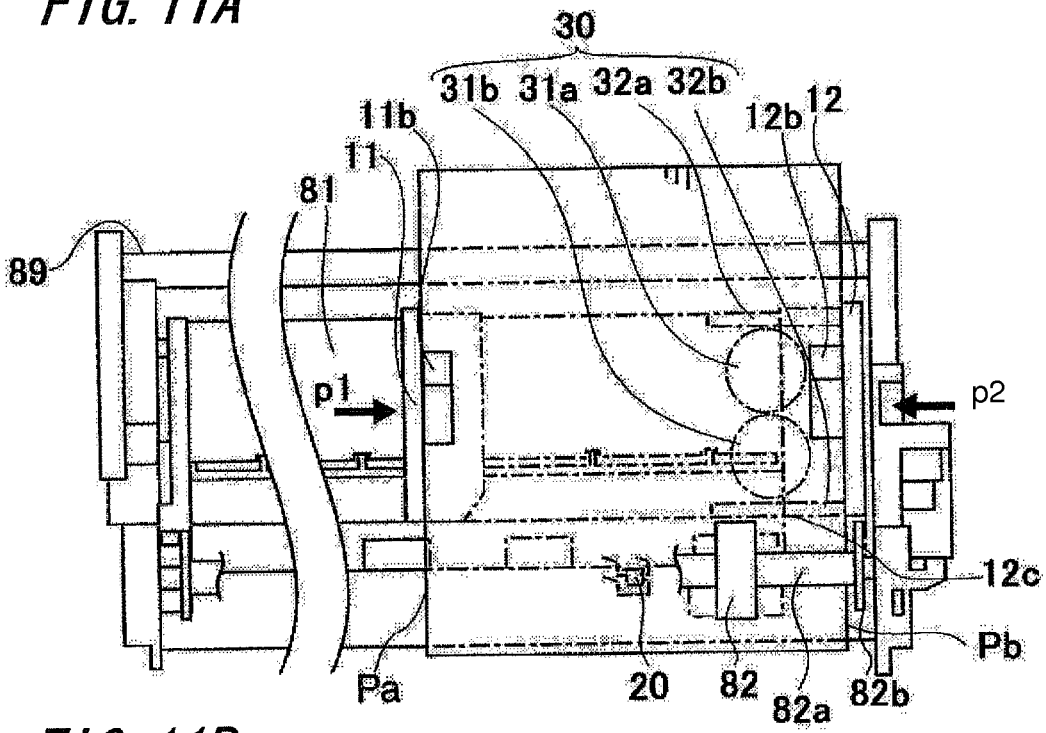
Figure 11B:
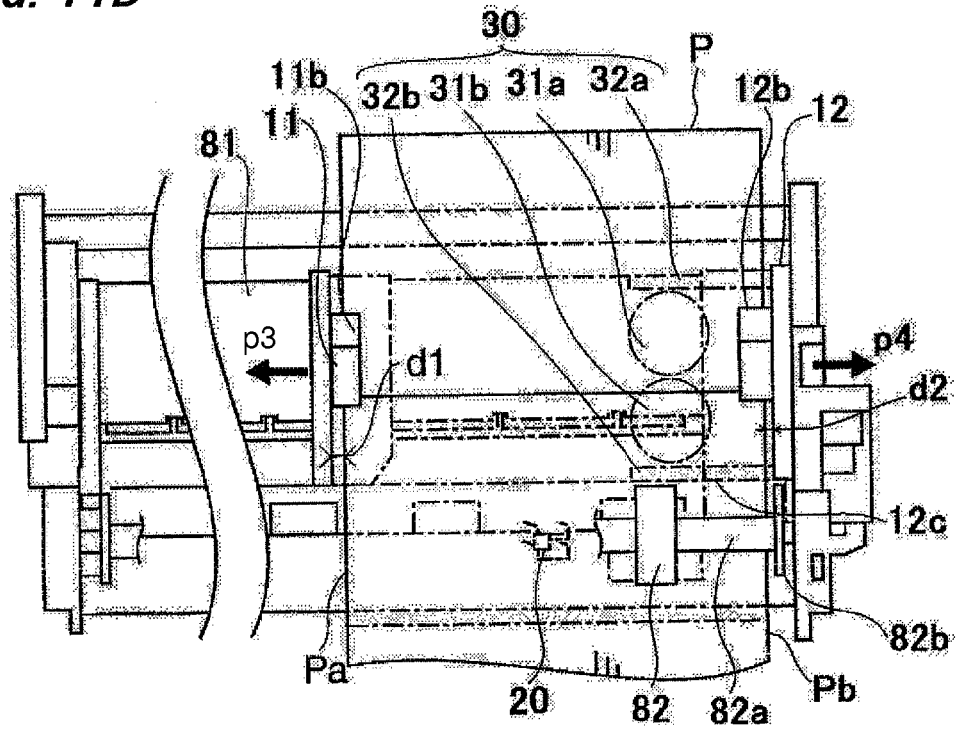

According to the edge guide moving mechanism 20 having the structure, the edge guide 11 can be moved from a first position p1 in FIG. 11A to a second position p3 in FIG. 11B with the pivoting motion of the hopper 81. In the first position p1, a side end Pa of the paper P abuts on the edge guide 11. In the second position p3, a gap d1 is formed between the side end Pa of the paper P and the edge guide 11. Accordingly, it is possible to prevent a frictional contact in the side end Pa of the paper P on the edge guide 11 side, thereby eliminating a frictional resistance (a back tension).

At the same time that the hopper 81 is moved together with the edge guide 11 in the primary scanning direction by means of the edge guide moving mechanism 20, furthermore, the reference end guide 12 can be moved from a third position p2 in FIG. 11A to a fourth position p4 in FIG. 11B by means of the reference end guide moving mechanism 30. In the third position p2, a side end Pb of the paper P abuts on the reference end guide 12. In the fourth position p4, a gap d2 is formed between the side end Pb of the paper P and the reference end guide 12. Also in the side end Pb of the paper P on the reference end guide 12 side, accordingly, it is possible to prevent a frictional contact, thereby eliminating a frictional resistance (a back tension).

In the recording operation in the latter stage of the paper feed, thus, the edge guide 11 and the reference end guide 12 are released from both side ends of the paper. Therefore, it is possible to prevent the frictional contact of both side ends of the paper and the edge guide 11 and reference end guide 12, thereby eliminating a frictional resistance, and to maintain a recording picture quality with high precision also in a paper having a large size. Moreover, the movement of the edge guide moving mechanism 20 and the reference end guide moving mechanism 30 can utilize the pivoting motion of the hopper 81. Therefore, it is not necessary to provide a new power source. Furthermore, the edge guide moving mechanism 20 and the reference end guide moving mechanism 30 are only provided with the guide protruded portion 21 and the guide groove 22, the pinion gears 31*a* and 31*b*, and the rack gears 32*a* and 32*b*. Consequently, it is possible to have a simple structure. In addition, the guide groove 22 of the edge guide moving mechanism 20 is provided with the straight groove 22*a* and the inclined groove 22*b*. Therefore, the movement of the edge guide 11 and the reference end guide 12 in the primary scanning direction can be controlled based on the pivoting motion of the hopper 81 in one cycle. Furthermore, the guide groove 22 is provided with the straight groove 22*a* on the paper feeding roller 82 side. Therefore, there is no possibility that the press of the paper P against the paper feeding roller 82 to be the original functions and advantages of the hopper 81 might be hindered.

While the description has been given by taking the printer of the ink jet type as an example of the recording apparatus, any recording apparatus such as a facsimile apparatus or a copying apparatus can be applied. In addition to the recording apparatus, moreover, the invention can also be applied to an apparatus comprising a coloring material ejecting head to be used for manufacturing a color filter in a liquid crystal display, an electrode material (a conductive paste) ejecting head to be used for forming an electrode in an organic EL display or a surface emitting display (FED), a bioorganic ejecting head to be used for manufacturing a biochip or a sample ejecting head to be a precision pipette, for example, as a liquid ejecting apparatus for ejecting a liquid corresponding to uses from a liquid ejecting head onto a medium to be ejected, thereby sticking the liquid onto the medium to be ejected in place of an ink.

What is claimed is:

1. A medium feeding apparatus comprising:

a pivot unit, supporting a medium and pivoting to cause the medium to come in contact with and to separate from a feeding unit;

a first guide unit, guiding one side end of the medium supported on the pivot unit;

a second guide unit, guiding the other side end of the medium;

a first moving unit, moving the first guide unit to come in contact with and to separate from the one side end of the medium in conjunction with the pivoting motion of the pivot unit; and a second moving unit, moving the second guide unit to come in contact with and to separate from the other side end of the fed medium in conjunction with the movement of the first guide unit;

wherein the first moving unit includes a guide protruded portion and a guide groove to be engaged with the guide protruded portion; and wherein the guide groove has a straight groove formed on a side of the feeding unit and extended in a direction of the pivoting motion of the pivot unit, and an inclined groove which is inclined with respect to the straight groove and is formed on an opposite side to the feeding unit.

2. A medium feeding apparatus comprising:

a pivot unit, supporting a medium and pivoting to cause the medium to come in contact with and to separate from a feeding unit;

a first guide unit, guiding one side end of the medium supported on the pivot unit;

a second guide unit, guiding the other side end of the medium;

a first moving unit, moving the first guide unit to come in contact with and to separate from the one side end of the medium in conjunction with the pivoting motion of the pivot unit; and a second moving unit, moving the second guide unit to come in contact with and to separate from the other side end of the fed medium in conjunction with the movement of the first guide unit;

wherein the pivot unit is also moved with the movement of the first guide unit;

wherein the first moving unit includes a guide protruded portion and a guide groove to be engaged with the guide protruded portion; and wherein the guide groove has a straight groove formed on a side of the feeding unit and extended in a direction of the pivoting motion of the pivot unit, and an inclined groove which is inclined with respect to the straight groove and is formed on an opposite side to the feeding unit.

3. A medium feeding apparatus comprising:

a pivot unit, supporting a medium and pivoting to cause the medium to come in contact with and to separate from a feeding unit;

a first guide unit, guiding one side end of the medium supported on the pivot unit;

a second guide unit, guiding the other side end of the medium;

a first moving unit, moving the first guide unit to come in contact with and to separate from the one side end of the medium in conjunction with the pivoting motion of the pivot unit; and a second moving unit, moving the second guide unit to come in contact with and to separate from the other side end of the fed medium in conjunction with the movement of the first guide unit;

wherein the second moving unit includes a pair of pinion gears and a pair of rack gears to be engaged with the pinion gears.

4. The medium feeding apparatus according to claim 3, wherein the pinion gears are attached to the pivot unit and the rack gears are attached to the second moving unit.

5. A medium feeding apparatus comprising:

a pivot unit having a protruded portion at lower edge thereof;

an abutment portion, disposed below the pivot unit and having a groove therein;

a first guide unit, fixing its position with respect to the pivot unit while the pivot unit pivots;

a second guide unit, disposed opposite to the first guide unit with respect to the pivot unit, wherein the protruded portion of the pivot unit moves along the groove of the abutment portion and thereby the first guide unit and the second guide unit change the distance therebetween;

wherein the groove including a straight groove extended in a direction of the pivoting motion of the pivot unit and an inclined groove which is inclined with respect to the straight groove and thereby the first guide unit moves toward or separates from the second guide unit.

6. The medium feeding apparatus according to claim 5, wherein a pair of pinion gears attached to the pivot unit and a pair of rack gears are engaged with each other and thereby the second guide unit moves toward or separates from the first guide unit.

* * * * *